US005314348A

United States Patent [19]

Wu

[11] Patent Number: 5,314,348

[45] Date of Patent: May 24, 1994

[54] INNER LOCK TYPE FASTENING CONSTRUCTION OF A LIGHT BULB HOLDER

[76] Inventor: Hsin-Wei Wu, No. 5, Lane 193, Kon Yua Rd., Hsin-chu, Taiwan

[21] Appl. No.: 24,959

[22] Filed: Mar. 2, 1993

[51] Int. Cl.[5] ..... H01R 13/627

[52] U.S. Cl. ..... 439/356

[58] Field of Search ..... 439/232, 233, 617, 619, 439/557, 558, 242-244, 356

[56] References Cited

U.S. PATENT DOCUMENTS

| | | | |
|---|---|---|---|
| 3,399,374 | 8/1968 | Pauza et al. | 439/358 |
| 3,409,859 | 11/1968 | Krehbiel | 439/357 |
| 4,970,632 | 11/1990 | Tseng | 439/619 |
| 4,999,751 | 3/1991 | Chen | 439/356 |
| 5,013,258 | 5/1991 | Schaef | 439/233 |

*Primary Examiner*—Gary F. Paumen

*Attorney, Agent, or Firm*—Morton J. Rosenberg; David I. Klein

[57] ABSTRACT

A light bulb holder is provided which relies on an inner lock type fastening construction to provide optimal securement. The light bulb holder includes a cap and a base. The base has a through groove formed through a lower section sidewall. A through base and axial opening are formed through the base. A slot is formed within the base sidewall and the cap has a tongue molded on the side of a stub of the cap. The cap is inserted in the base and axial openings of the base in a manner such that the stub and the tongue are accommodated in the axial hole and the slot respectively so that a protrusion portion of the tongue engages the base sidewall through the through groove thus firmly securing the cap to the base with an optimal locking effect.

1 Claim, 5 Drawing Sheets

INNER LOCK TYPE FASTENING CONSTRUCTION OF A LIGHT BULB HOLDER

FIELD OF THE INVENTION

This invention relates to light bulb holders. In particular, this invention pertains to an inner lock type fastening construction for light bulb holders. More in particular, this invention relates to a light bulb holder having a fastening construction in which a cap is provided having a tongue for insert through an open-ended groove or slot formed on a lower portion of a base member in a manner such that when the cap is inserted into the base, a protrusion on the tongue of the cap firmly engages with a sidewall of the base so that the connection between the cap and the base is secure.

PRIOR ART

Prior art fastening systems for Christmas light bulb holders generally use a tight or force fit between the cap and the base, however, such a connection does not provide for secure coupling and loosening often occurs. In other prior art systems, male and female locking plates are provided on the sides of cap members or base members, however, they are often decoupled by inadvertent handling during installation and thus may need to be reassembled resulting in lost assembly time and increased labor costs.

SUMMARY OF THE INVENTION

An object of the invention is to provide an inner lock type cap and base construction that can be quickly connected and disconnected while providing a secure and reliable joint structure.

The features, objects and other advantages of the invention may be further understood from the detailed description given hereinafter when read in conjunction with the accompanying drawings.

DESCRIPTION OF THE PREFERRED EMBODIMENTS

Figure 1:
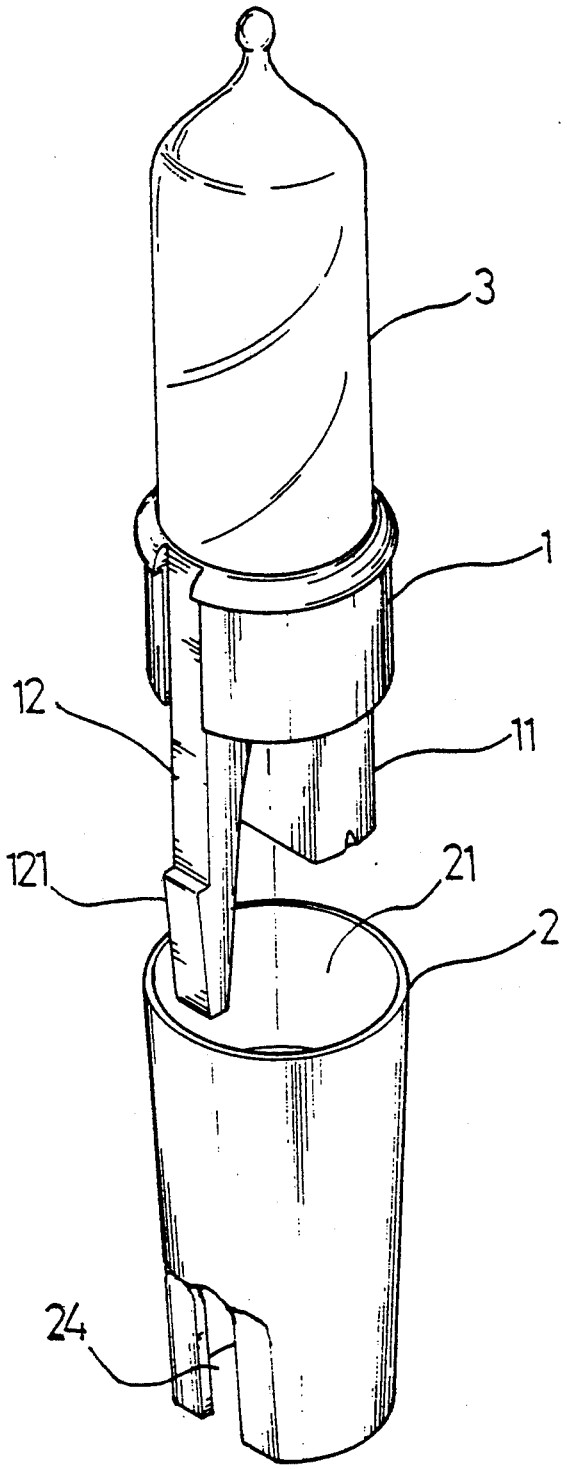
FIG. 1 is a perspective view showing an embodiment of the invention.
Figure 2:
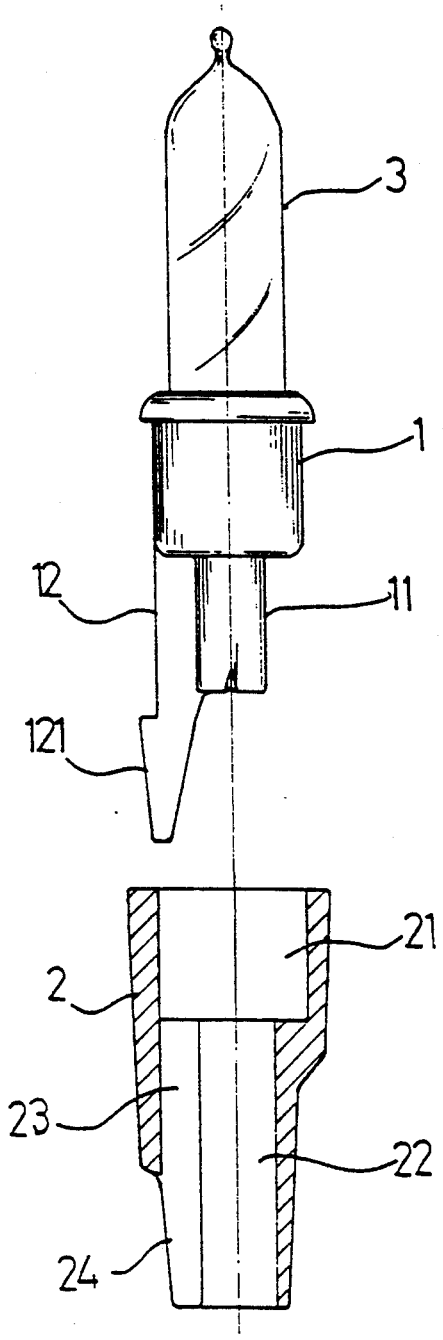
FIG. 2 is a partial sectional view of the embodiment shown in FIG. 1.

Referring now to FIGS. 1 and 2, there is shown the light bulb holder including cap 1 accommodating a light bulb within an upper or first end portion. The cap 1 has a stub 11 formed on its lower or second end portion and a tongue 12 molded on a sidewall extending below the end of stub 11. The tongue 12 has a protrusion 121 formed on a front end as shown in the Figures. The base member 2 is provided having an opening 21 defining a base opening diameter and an axial hole 22 defining an axial diameter less than the diameter of the base opening to form a shoulder as shown in the Figures. A slot 23 is formed in a sidewall of the base member 2 and has a through groove 24 formed through the lower side thereof.

Figure 3:
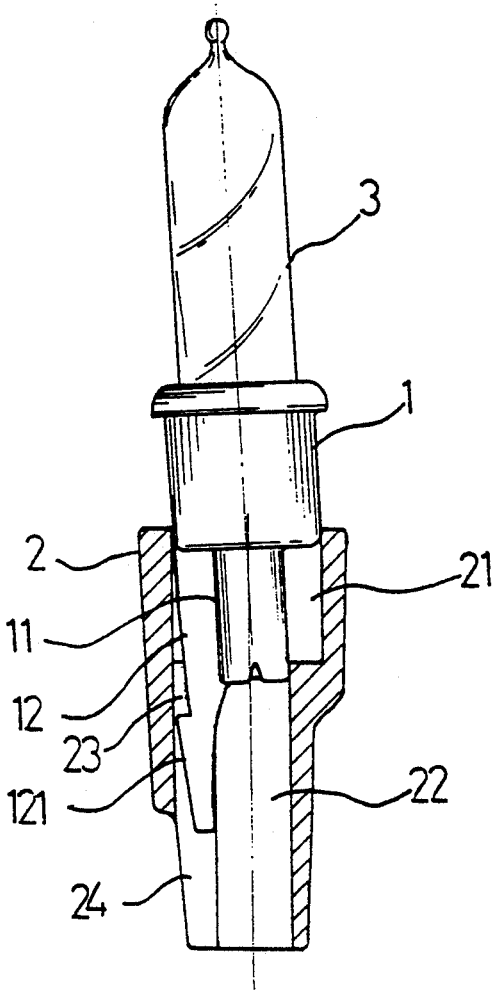
FIG. 3 is a partial sectional view showing partial insertion of the cap member within the base member.
Figure 4:
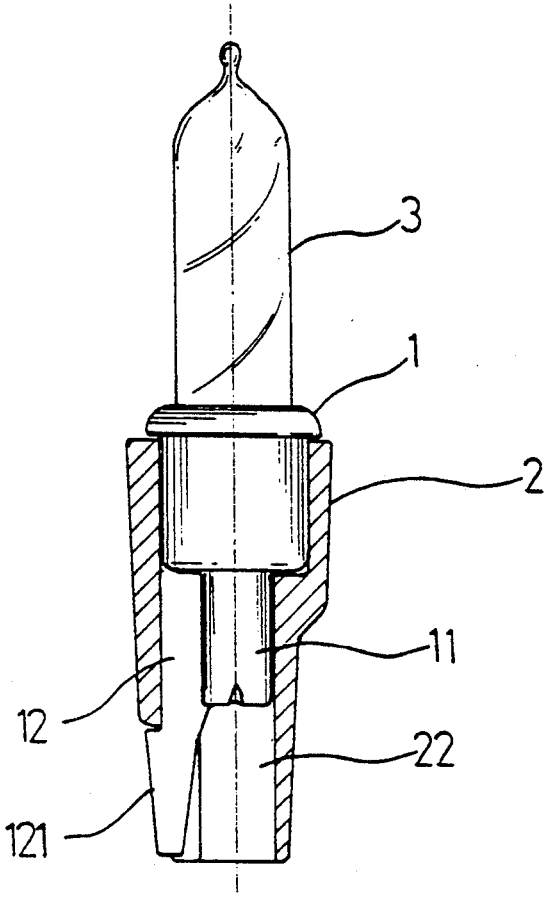
FIG. 4 is a partial sectional view showing the assembled fastening construction; and, FIG. 5 is a perspective view illustrating the configuration of the invention system after assembly.
Figure 5:
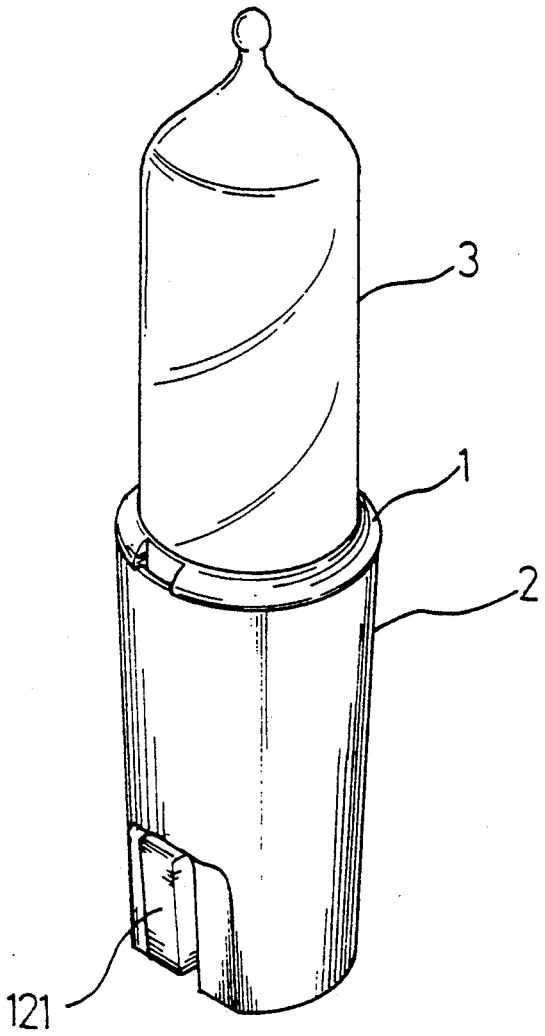

As is seen in FIGS. 3–5, when the cap 1 is inserted into the base 2, the tongue 12 of the cap 1 enters the slot 23 along the opening 21 of the base 2 while simultaneously the stub 11 is inserted into the axial hole 22 as shown in FIG. 3. The cap 1 is inserted until the cap 1 and the stub 11 are completely accommodated in the opening 21 and the axial hole 22 of the base 2 and the cap 1 rests on the shoulder defined by the openings 21 and 22. The protrusion 121 of the tongue 12 is caught by the sidewall of the base member 2 due to its insertion into the through grove 24 located in the lower portion of the slot 23 which effects a securing function for the assembly as shown in FIGS. 4 and 5.

As described above, the invention provides a securing construction that enhances locking effects that have never been seen in conventional fastening constructions where such is locked from the outside of the construction.

What is claimed is:

1. A light bulb holder for positionally locating and stabilizing a light bulb comprising:

(a) a cap member extending in a vertical direction having a first end portion for insertion of said light bulb therein, and a second end portion, said second end portion of said cap member defining a stub member having a vertically extending tongue member forming a protrusion at one end thereof, said tongue member being secured to a sidewall of said stub member and extending beyond an extension length of said stub member;

(b) a base member extending in said vertical direction having a base opening defining a base opening diameter in open communication with a base axial hole defining a base axial diameter less than said base opening diameter for providing an internal shoulder member of said base member, said base axial opening having a vertically extending slot formed within an internal sidewall thereof and a vertically extending opening through a lower section of said sidewall in alignment with said slot for passage therethrough of said protrusion, said cap member having a first end portion diameter greater than said base opening diameter whereby when said cap first end portion is positioned contiguous an upper surface of said base member, said cap second end portion is positioned contiguous said shoulder and said protrusion extends through said vertically extending opening thereby providing a fixed securement for said cap member and said light bulb.

* * * * *